US006797908B2

(12) United States Patent
Yan et al.

(10) Patent No.: US 6,797,908 B2
(45) Date of Patent: Sep. 28, 2004

(54) HIGH-TENSION ELECTROSTATIC CLASSIFIER AND SEPARATOR, AND ASSOCIATED METHOD

(75) Inventors: Eric S. Yan, Orange Park, FL (US); Thomas J. Grey, Jacksonville, FL (US); Kevin R. McHenry, Jacksonville, FL (US)

(73) Assignee: Outokumpu Oyj, Espoo (FI)

( * ) Notice: Subject to any disclaimer, the term of this patent is extended or adjusted under 35 U.S.C. 154(b) by 146 days.

(21) Appl. No.: 10/120,017

(22) Filed: Apr. 10, 2002

(65) Prior Publication Data

US 2003/0192813 A1 Oct. 16, 2003

(51) Int. Cl.[7] ..... B03C 7/06

(52) U.S. Cl. ..... 209/131; 209/127.1; 209/127.4; 209/128; 209/129; 209/130

(58) Field of Search ..... 209/127.1, 131

(56) References Cited

U.S. PATENT DOCUMENTS 2,559,076 A * 7/1951 Johnson ..... 209/127.4
3,322,275 A 5/1967 Breakiron et al.
5,161,696 A 11/1992 Seider
5,484,061 A 1/1996 Dunn

* cited by examiner

*Primary Examiner*—Donald R Walsh
*Assistant Examiner*—Jonathan R Miller
(74) *Attorney, Agent, or Firm*—Arthur G. Yeager

(57) ABSTRACT

The electrostatic classifier and separator is supported by a housing and includes a corona classifier section for classifying particulate materials according to size. Corona element supplies mobile ions for bombarding particulate materials dropping down a passageway from a reservoir. A splitter and screen may be included in the passageway to direct particulate materials into respective fractions. First separator section receives fine to middle size fractions and second separator section receives middle to coarse size fractions. A support frame having adjustable slots supports a plurality of static electrodes. Corona element for emitting a corona charge is spaced generally in a first quadrant of first separator section. A rotatable brush and an alternating current wiper may be included for removing fine to middle size nonconductive fractions from first separator section. Additional splitter and/or a baffle may be included to help guide particulate material fractions into respective containers, onto a conveyor belt or the like. In an alternate embodiment, the corona classifier section may be housed and powered separately and independently from first and second separator sections.

41 Claims, 7 Drawing Sheets

HIGH-TENSION ELECTROSTATIC CLASSIFIER AND SEPARATOR, AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to an electrostatic separator for the benificiation or separation of particulate materials and, more particularly, to a high-tension electrostatic separator including a corona classifier section for classifying particulate materials according to size, and associated method.

2. Prior Art

Electrostatic separation is based upon the ability to electrically charge particulate materials having different conductive properties and then separate such particulate materials when an external electric field is applied thereto. Three main charging mechanisms applied to electrically separated particulate materials include induction, triboelectrification, and ion bombardment. Because the electrostatic force created by these mechanisms is proportional to the surface charge of the available surface area of the particulate materials and the intensity of the electric field, physical characteristics such as size, shape and specific gravity impact this process.

In general, particulate material sizes effectively separated by a high-tension electrostatic separator is coarser than approximately 100 $\mu$m. In practice, uniform feed particulate material size provides better separation efficiency. Therefore, effective sizing of the particulate materials should be addressed with high-tension electrostatic separation processes to render more effective results. Screening is one method of sizing particulate materials. However, the efficiency decreases rapidly for fine particulate materials. For particulate material sizes finer than 250 $\mu$m, sizing is normally performed by classification techniques. Size classification is based upon the velocity with which particulate materials fall through a medium such as air and water, for example.

In a conventional high-tension electrostatic separator, particulate materials are commonly introduced on top of a roll-type electrode. The position of a charging (corona) electrode and a static electrode, as well as the roll-rotation speed is influenced by the characteristic of particulate materials. For particulate materials having wider size distributions, the separation process requires several stages of retreatment to obtain satisfactory separation. Accordingly, from a processing point of view, it is necessary to classify such particulate materials into narrower size fractions, prior to separation, to obtain higher separation efficiency.

It is known in prior art that a high-tension electrostatic separation process has better separation efficiency with particulate materials having narrower size distributions. It has also been established that roll-type, high-tension separators are more suitable for separating finer particulate materials while plate-type, induction separators are more suitable for separating coarser particulate materials.

A significant problem with high-tension electrostatic roll-type, separators is that the fine conducting particulate materials remain on the roll outer drum surface and are misplaced with nonconducting particulate materials. This can be attributed to fine particulate materials having a higher surface charge, less inertia/centrifugal forces, as well as being susceptible to particle entrapment.

Fine particulate materials may acquire higher charges because their specific surface area is larger than the specific surface area of a coarse particulate material. Accordingly, the electrode arrangement used to separate fine particulate materials should provide a narrower corona field, less corona current, and a wider and stronger static field. In addition, higher roll-rotation speeds should be used to insure that fine conducting particulate materials leave the electrode outer drum surface as early as possible.

Alternately, coarse particulate materials have smaller specific charges. However, such coarse particulate materials have larger centrifugal forces acting thereon because their centrifugal forces are proportional to the cube of their radius. Therefore, for separating coarse particulate materials, a significant problem is that the coarse nonconducting particulate materials leave the roll-type electrode outer drum surface too early. Also, such coarse nonconducting particulate materials can be misplaced with conducting particulate materials if their surface charges are not sufficient. Consequently, the electrode arrangement used to separate coarse particulate materials should provide a wider corona field to enhance the charging thereof. In addition, the roll-rotation speed should be lower to minimize the negative effect from the centrifugal force acting on the coarse particulate materials.

Accordingly, to obtain optimal separation performance, finer and coarser fractions of particulate materials should be classified and subsequently separated with different types of electrostatic separators. However, size classification is such a task that people want to avoid unless it is necessary. Size classification by means of electrostatic techniques has been reported in literature. These techniques mainly deal with classifying dry, fine powder when conventional size classifying processes fail to provide satisfactory separation. For example, a prior art attempt to separate fine, dust-like particulate material is disclosed in U.S. Pat. No. 3,222,275 to Breakiron et al. According to this patent, very fine particulate materials that are of a mesh size of −200 are amenable to high-tension separation with a spray of mobile ions produced by a corona discharge.

Most techniques for classifying particulate materials employ the phenomenon that particulate materials become charged by means of induction when they are subject to a strong electric field. Size separation may thereby be achieved by passing charged particulate materials through electrified sieves. For example, U.S. Pat. No. 5,484,061 to Dunn discloses such an electrostatic sieving apparatus for classifying particulate materials according to size. U.S. Pat. No. 5,161,696 to Seider discloses an apparatus for separating shapes of abrasive grains by imposing a high-voltage corona induction charge to free-falling abrasive particulate materials.

In addition to particulate material size, operating parameters affect an electrostatic separator's performance. Such operating parameters are roll speed, number of corona electrodes and their corresponding position with respect to the grounded electrode, intensity and polarity of applied potential, particulate material rate, electrode surface cleaning, temperature of the particulate materials, and splitter positions.

BRIEF SUMMARY OF THE INVENTION

In view of the foregoing background, it is therefore an object of the invention to provide a high-tension electrostatic classifier and separator that may include a corona classification section for classifying feed particulate materials into a fine to middle size fraction and middle to coarse size fraction before such fractions are separated by a roll electrode separator and plate electrode separator, respectively. These and other objects, features, and advantages of the invention, are provided in a high-tension electrostatic separator for classifying and separating particulate materials based upon size and conductivity that may include a corona classifier that may have an elongated passageway having generally planar sidewalls defining a first end for receiving particulate materials and a second end for directing the particulate materials into two fractions according to size. The corona classifier may further include corona means located adjacent one of the sidewalls for providing ion bombardment in a horizontal direction to particulate materials dropping down the passageway so that middle to coarse size particulate materials travel in a more generally vertical direction and fine to middle size particulate materials travel in a less generally vertical direction, while passing through the passageway.

A splitter may be located in the passageway downstream of the corona means to direct middle to coarse size particulate materials in a first path toward the one sidewall and fine to middle size particulate materials in a second path toward another of the sidewalls. The splitter may be adjustable on an axis extending generally parallel to the sidewalls and perpendicular to a longitudinal axis of the passageway. Further, the separator may include means for receiving fine to middle size particulate materials and middle to coarse size particulate materials for separating the particulate materials into a plurality of distinct fractions.

The corona means may include a plurality of spacers extending from the one sidewall in a generally horizontal direction and between opposed sidewalls of the passageway. The sidewalls of the passageway may be conductive. A plurality of spaced corona electrodes extend adjacent and along the one sidewall and may have opposite ends connected to the plurality of spacers so that the plurality of corona electrodes are spaced from the one sidewall. The plurality of spacers are non-conductive for isolating the plurality of corona electrodes from the one sidewall.

A reservoir is located above the passageway for feeding particulate materials therein by gravity into a thin stream generally equal in width along and spaced from the one sidewall of the passageway. The corona classifier may further include a screen located within the passageway and connected to the splitter for providing enhanced separation of middle to coarse size particulate materials from fine to middle size particulate materials. The screen has a mesh surface for passing fine to middle size particulate materials therethrough and for inhibiting middle to coarse size particulate materials from passing therethrough. The screen may be nonconductive.

The splitter may include an upper edge portion for supporting the screen. Further, the screen may extend generally between opposed sidewalls of the passageway. The splitter may have a rotatable base generally opposite to the upper edge portion for pivoting the splitter and screen toward and away from the one sidewall and for moving the splitter upwardly and downwardly. The corona classifier section may further include a plurality of baffles extending along the length of the passageway and spaced from each other in the general path of the middle to coarse size particulate materials. The plurality of baffles assist in retarding the fall of the middle to coarse size particulate materials.

The corona classifier may further comprise a housing having a plurality of elongated and generally vertical members with respective first ends that are attached and extend from corresponding corners of a base member. The housing has a plurality of elongated and generally horizontal members for connecting to corresponding second ends of the plurality of generally vertical members so that the housing may define a hollow space for generally supporting the corona classifier therein. The housing may be conductive.

The present invention also provides a method for classifying and collecting particulate materials according to size. The method includes passing particulate materials through a passageway in close proximity to a corona source for charging thereof. The method further includes classifying particulate materials traveling through the passageway according to size so that particulate materials are directed into diverging paths with a first path being for fine to middle size particulate materials and a second path being for middle to coarse size particulate materials. The separated fine to middle size and middle to coarse size fractions may then be collected or further processed.

To further aid in classifying the particulate materials, an adjustable splitter and a screen attached thereto may be installed in the passageway for providing enhanced classification of fine to middle size particulate materials from middle to coarse size particulate materials. A plurality of spaced containers are placed adjacent to a respective path of middle to coarse size conductive particulate materials and middle to coarse size nonconductive particulate materials for collecting thereof. Similarly, a plurality of spaced containers are placed adjacent to a respective path of fine to middle size conductive particulate materials and fine to middle size nonconductive particulate materials for collecting thereof. The plurality of spaced corona electrodes should be coated with a nonconducting polymer for inhibiting electric shock when touched and for preventing arcing.

In an alternate embodiment, a high-tension electrostatic separator for classifying and separating particulate materials based upon size and conductivity is disclosed. The separator includes a corona classifier section that classifies particulate materials according to size and directs same to first and second separators.

The first separator section receives fine to middle size particulate materials from the first path of the passageway and separates same according to conductivity. The first separator section includes an elongated cylindrical, grounded, conductive body having a rotative longitudinal axis and a substantially smooth outer drum surface for receiving fine to middle size particulate materials thereon, means for rotating the body about the longitudinal axis, and shaft means extending outwardly from opposite ends of the body along the longitudinal axis. The first separator section further includes a splitter located spacedly therefrom and generally in the second quadrant for separating fine to middle size conductive particulate materials from fine to middle size nonconductive particulate materials. The splitter should be adjustable on an axis extending parallel to the longitudinal axis of the body.

A support frame is disposed outwardly of the corona classifier section and the first separator section. The frame includes a pair of journals to support the shaft means for the rotating body. The first separator section includes an alternating current wiper located generally in a third quadrant for removing fine to middle size nonconductive particulate materials from the outer drum surface. The first separator section further includes a rotatable brush generally midway of the third and fourth quadrants for removing any remaining fine to middle size particulate materials from the outer drum surface. The first separator section may also include a baffle located spacedly therefrom and generally in the third quadrant for directing fine to middle size particulate materials into a corresponding container.

A corona means is supported by the frame located spacedly above the outer drum surface and angularly downstream from depositing fine to middle size particulate materials on the outer drum surface. A plurality of spaced, elongated static electrodes extend adjacent and along the outer drum surface of the body and may have opposite ends supported by spaced arcuate buses. The plurality of static electrodes are positioned at selected locations within first and second quadrants of the cylindrical body for providing a static electric field for attracting fine to middle size conductive particulate materials from the outer drum surface while fine to middle size nonconductive particulate materials remain pinned to the outer drum surface for subsequent removal as the body rotates. Each of the plurality of static electrodes may be coated with a nonconductive polymer for inhibiting electric shock when touched and for preventing arcing.

The present invention further includes a second separator section for receiving middle to coarse size particulate materials from the second path of the passageway and for separating same into conductive and nonconductive fractions. The second separator section includes a curved, declining, grounded and conductive plate and a plurality of spaced electrodes spacedly located adjacent and above the plate for producing an electric field to attract and lift middle to coarse size conductive particulate materials from the plate while permitting middle to coarse size nonconductive particulate materials to travel by gravity on the declining plate.

The second separator section includes a splitter located spacedly between the plate and the electrodes for separating middle to coarse size conductive particulate materials from middle to coarse size nonconductive particulate materials. The splitter is adjustable on an axis extending parallel to the longitudinal axis of the plate.

Advantageously, the present invention provides corona-aided particulate material classification, an enhanced static electric field, a cylindrical, conductive rotative outer drum surface for separating fine particulate materials and a plate electrode surface for separating coarse particulate material. The present invention may further include a plurality of containers generally below the outputs from the high-tension electrostatic separator for respectively receiving middle to coarse size conductive particulate materials and middle to coarse size nonconductive particulate materials from the second separator section, and fine to middle size conductive particulate materials and fine to middle size nonconductive particulate materials from the first separator section. The plurality of containers may be nonconductive. The housing may further include means for removably securing the high-tension electrostatic separator thereto and generally within the hollow space of the housing.

Advantageously, the high-tension electrostatic classifier and separator may split narrower-sized fractions of particulate materials into more fractions according to conductivity. The present invention also provides an enhanced static electrode arrangement providing enhanced attraction force for separating fine conductive particulate materials. The side-by-side first and second separator sections improve separation efficiency and throughput capacity.

The present invention also provides a method for classifying and separating particulate conductive and nonconductive materials. The method may include passing particulate materials through a passageway in close proximity to a corona source for charging thereof. Particulate materials traveling through the passageway are classified according to size so that the particulate materials are directed into diverging paths with a first path being for fine to middle size particulate materials and a second path being for middle to coarse size particulate materials.

Separation of fine to middle size particulate materials into conductive and nonconductive fractions by use of a rotating, cylindrical and grounded outer drum surface is disclosed herein. Fine to middle size particulate materials are moved past a corona charging location so that conductors of fine to middle size particulate materials are removed from the outer drum surface by a plurality of spaced static electrodes. As a result, the nonconductors of the fine to middle size particulate materials remain on the rotating outer drum surface until they drop off or are removed from the outer drum surface prior to a full rotation of the outer drum surface.

The method includes separating the middle to coarse size particulate materials into conductive fractions and nonconductive fractions with a curved, declining grounded plate so that conductive middle to coarse size particulate materials passing on the plate are lifted off therefrom due to an electrical field produced by a plurality of spaced static electrodes located above and along the plate and are separated from nonconductive middle to coarse size particulate materials remaining on the plate and falling therefrom. The method further includes collecting the separated conductive fine to middle size fraction from the nonconductive fine to middle size fraction, and collecting the separated conductive middle to coarse size fraction from the nonconductive middle to coarse size fraction. Other method steps are disclosed by the summary of the apparatus claims, infra.

Advantageously, the present invention provides a method for classifying and separating particulate materials that may maximize throughput capacity, minimize particle misplacement, and enhance the effectiveness of the static field intensity produced by the plurality of static electrodes. By incorporating the corona classifier section with the first separator section (roll electrode separator) and the second separator section (plate electrode separator), a wide range of particulate materials may be effective and efficiently separated with one pass through the present invention.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout, and prime and double prime notations are used to indicate similar elements in alternative embodiments.

Figure 1:
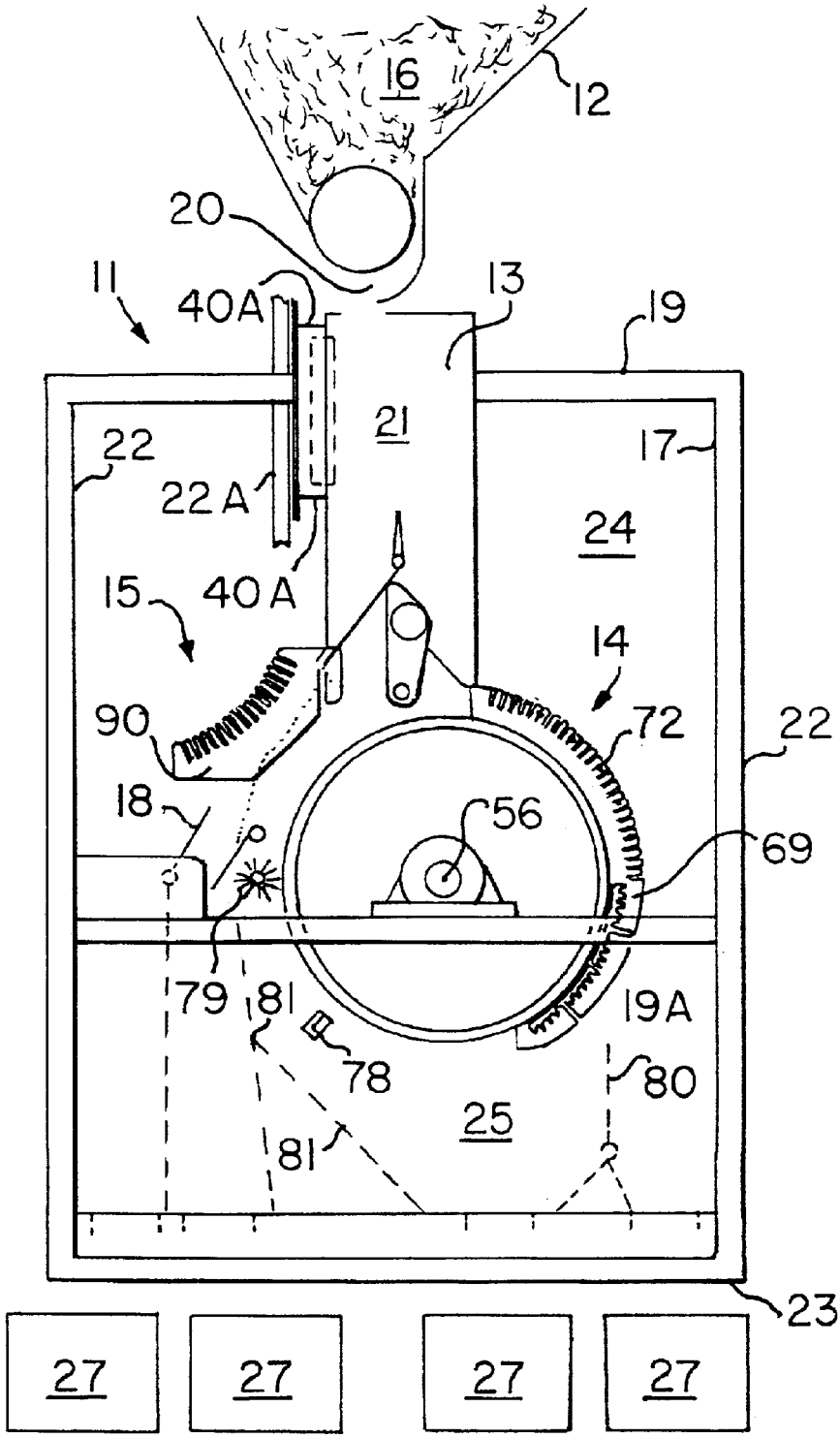
FIG. 1 is a pictorial end elevational view of the high-tension electrostatic classifier and separator in accordance with the present invention.

Referring initially to FIG. 1, hybrid electrostatic classifier and separator 11 is shown. Electrostatic classifier and separator 11 includes reservoir 12, corona classifier section 13, and first drum separator section 14 and second plate separator section 15. Reservoir 12 contains particulate materials 16 therein and is capable of dispensing same at variable rates. Particulate materials 16 are dispensed so that an equally spaced stream of particulate materials enters corona classifier section 13. Reservoir 12 is located spacedly above housing 17 in any known manner.

Housing 17 surrounds electrostatic classifier and separator 11 and includes a plurality of parallel and spaced elongate members 22 and base 23 connected thereto for forming hollow space 24 for receiving first and second separator sections 14, 15. Housing 17 provides an external framework for protecting electrostatic classifier and separator 11, while also allowing unobstructed views of the separator sections. Electrostatic classifier and separator 11 is supported within housing 17 such that they are supported and suspended above base 23. Thus, gap 25 exists between electrostatic classifier and separator 11 and base 23. Gap 25 allows access beneath electrostatic classifier and separator 11 for locating partitions and/or splitters to direct particulate materials into spaced containers 27, for example. Such containers are placed below gap 25 for collecting distinct particulate material fractions 73–76 shown in FIG. 3A.

Figure 2A:
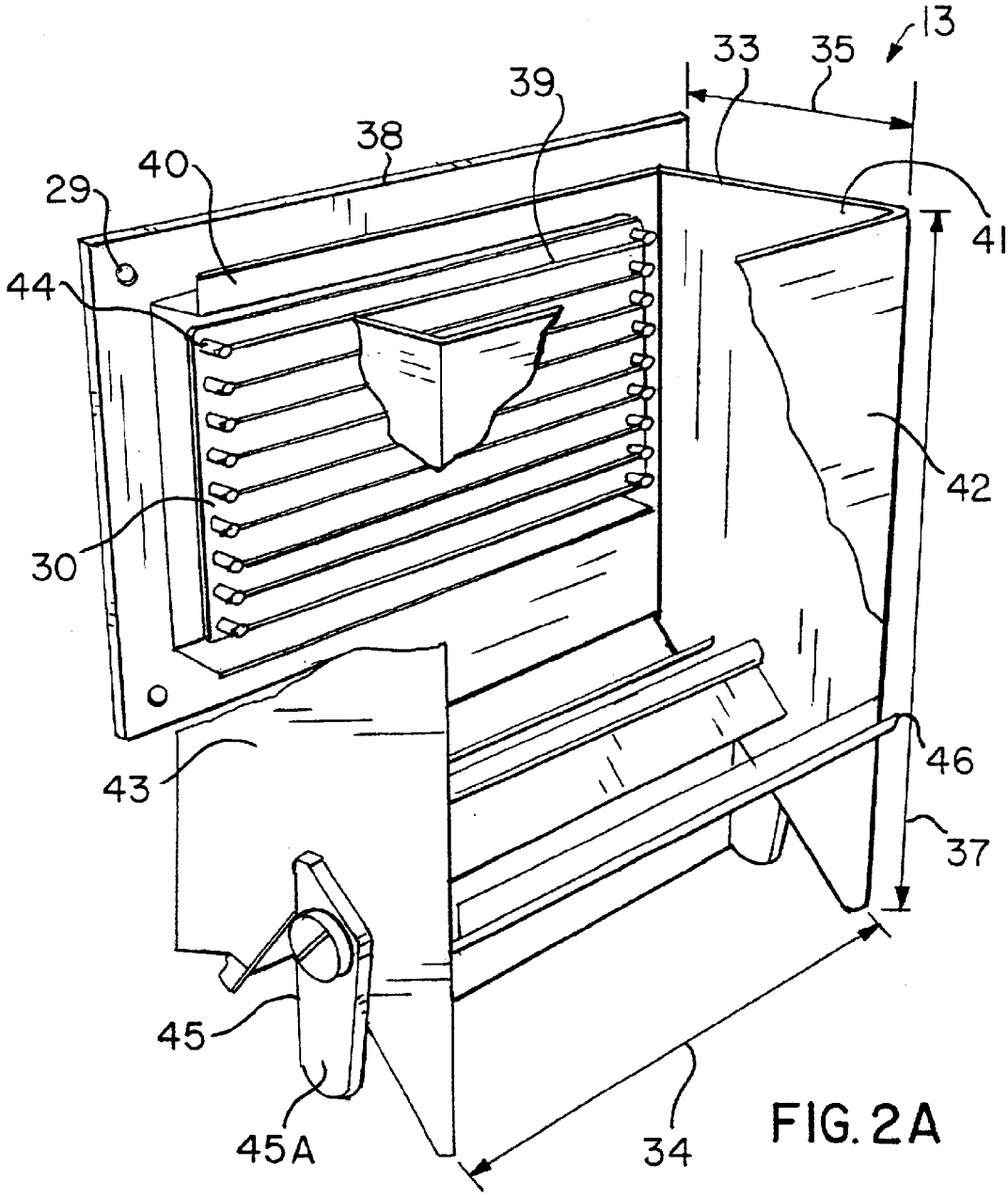
FIG. 2A is an enlarged perspective view of the corona classifier section shown in FIG. 1.
Figure 2B:
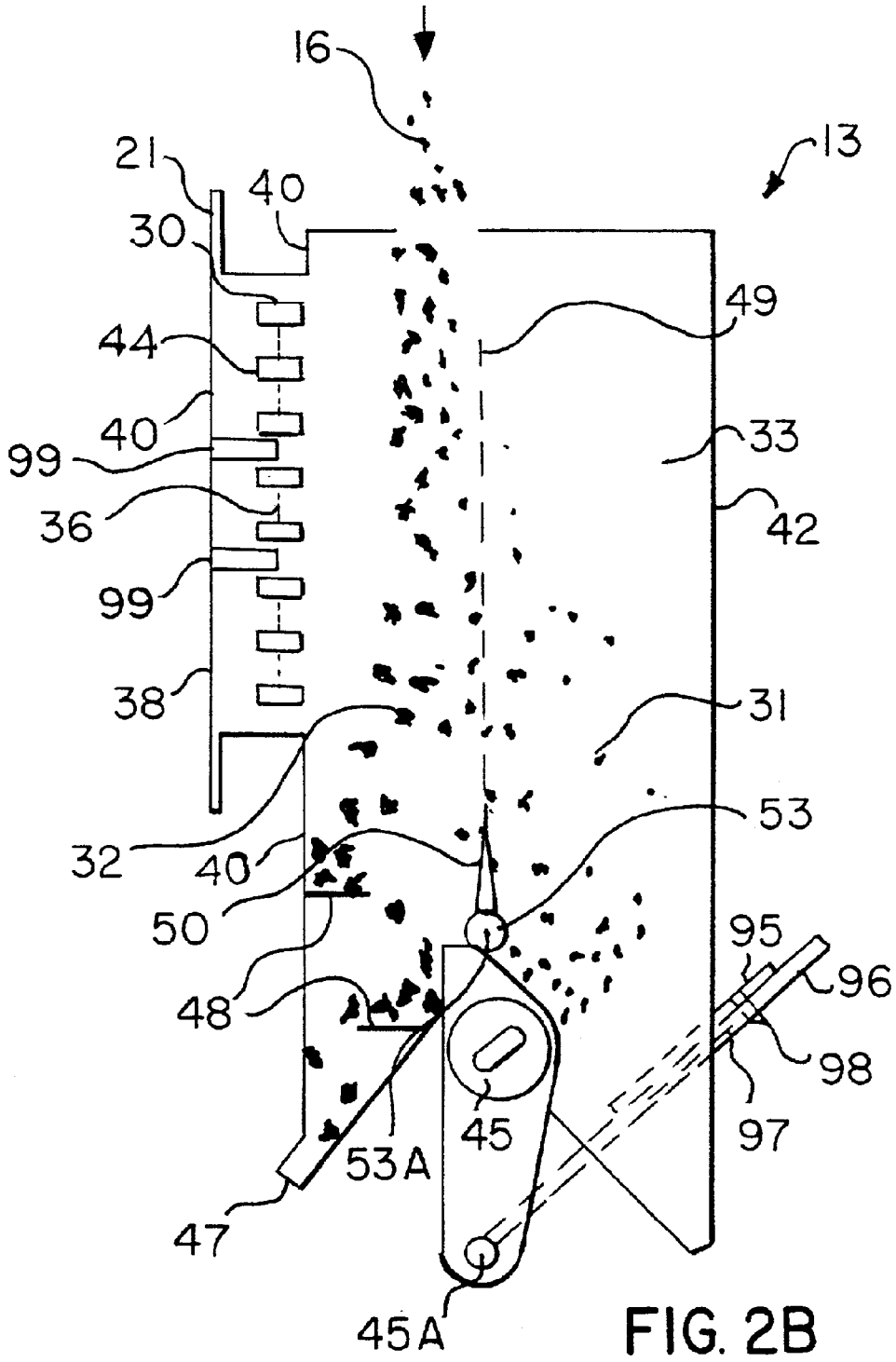
FIG. 2B is an enlarged pictorial end elevational view of the corona classifier section shown in FIG. 2A.

Now referring to FIGS. 2A and 2B, the corona classifier section 13 is shown. This section may be operated independent of and separate from first and second separator sections 14, 15. Thus, corona classification of particulate materials 16 according to size can be obtained without separating such particulate materials into conducting and nonconducting fractions. Corona classifier section 13 has a pair of longitudinal sidewalls 40, 42 and a pair of spaced end walls 41, 43 forming passageway 33 for receiving fine to coarse particulate materials 16. Opening 20 allows particulate materials 16 dropped from reservoir 12 to enter passageway 33 for being classified according to size.

Each wall 40–43 is electrically conductive and grounded for containing a corona field produced by corona-ionizing source 36. Passageway 33 has free-fall space or height 37 approximately equaling, for example, twenty inches for particulate materials 16 to pass therethrough. Such a height 37 is sufficient for allowing particulate materials 16 to be separated into two distinct fractions 31, 32 according to size. Of course, height 37 may be adjusted for providing more or less free-fall space for various types of particulate materials.

Corona-ionizing source 36 is engaged along first sidewall 40 and extends along length 34 thereof. In particular, corona-ionizing source 36 is housed in cavity 21 formed by first sidewall 40, top and bottom angle members 40, 40*a* and end angle members (not shown). Bolts 29 secure plate 38 to support members 22, 22*a*, which extend between member 19 and cross member 19*a* for attaching corona-ionizing source 36 thereto. A plurality of elongate and substantially parallel corona electrodes 39 are attached along length 34 of charged corona plate 30 via a plurality of selectively corresponding conductive elements 44. These conductive elements 44 support opposite ends of each corona electrode 39 and maintain same in spaced relationship to one another. Elements 44 pass through corona plate 30 so that a first portion is situated within passageway 33 with a second portion situated between corona plate 30 and plate 38. A plurality of spaced ceramic spacers 28 attach corona plate 30 to plate 38. Other nonconducting materials may be used to make spacers 28 such as rubber, for example.

Universal adjustment member 45, known in the art, is securely affixed at opposite ends to corresponding end walls 41, 43. Adjustment member 45 controls the discharge of fraction 31 exiting from passageway 33 and where same is deposited onto outer drum surface 54. By moving the position of member 45, in particular guiding member 45*a*, in a generally up and down and/or side-to-side direction, tray 46 moves to a corresponding location for directing fraction 31 onto outer drum surface 54. In particular, short plate 95 removably engages long plate 96. Such a long plate includes a plurality of grooves 97 whereat a plurality of corresponding fasteners 98 secures short plate 95 thereto. This short plate can be moved in a parallel direction along grooves 97 by loosening fasteners 98 and sliding short plate 95 therealong. Short plate 95 may then be secured in position by tightening fasteners 98. Advantageously, as fraction 31 lands on short plate 95, fraction 31 may be guided and deposited onto various locations of outer drum surface 54 for separation according to conductivity.

Figure 3A:
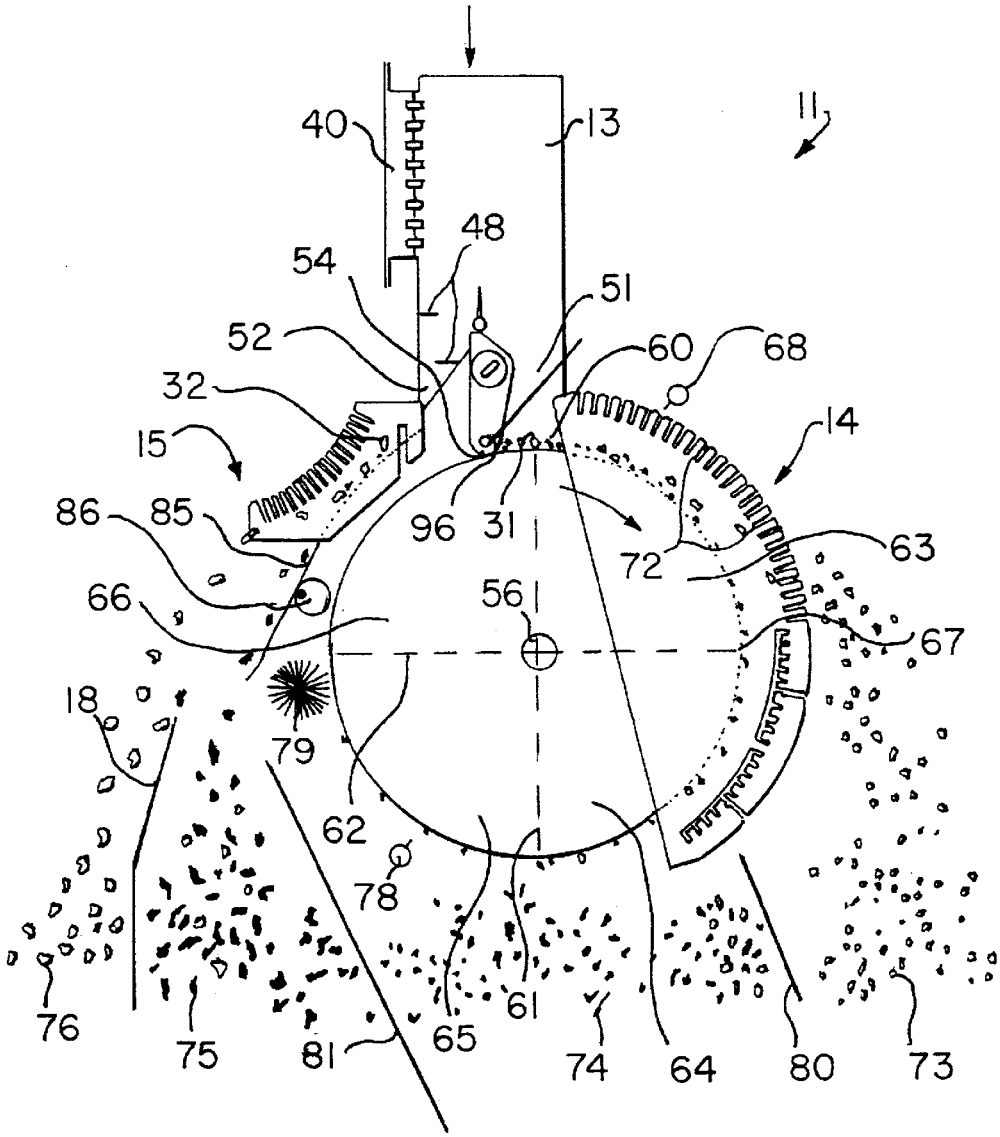
FIG. 3A is an enlarged pictorial end elevational view of the high-tension electrostatic classifier and dual section separator showing the separation of particulate materials according to size and conductivity.

As shown in FIGS. 2B and 3A, diaphragms or baffles 48 run along length 34 of passageway 33 to retard the fall of coarse fraction 32. Such baffles 48 create dead beds of particulate materials 16 inside passageway 33. Dead beds accumulate particulate materials 16 and assist in preventing coarse fraction 32 from striking baffles 48 and eroding the actual steel materials forming baffles 48.

Corona-ionizing source 36 subjects the passing particulate materials 16 to ion bombardment, which effectively sprays mobile ions generally horizontally towards the particulate materials 16 as same travel generally vertically through passageway 33. Because a particulate material charge density is proportional to its surface area and the intensity of the electric source (corona-ionizer), a particulate material's displacement in the x-axis during its free-fall in the y-axis is proportional to its size and surface charge. Accordingly, the fine to middle size particulate materials dropping by gravity thereby have a greater horizontal movement than the middle to coarse size particulate materials, when subjected to corona charges.

More particularly, particulate materials 16 fall in a generally vertical direction while corona-ionization is generated in a generally horizontal direction. The net effect of gravitational force and electrical force on the free-falling trajectory of particulate materials 16 is markedly different and provides that the fine to middle size particulate materials drift generally in the x-axis direction under the influence of the electrical force while the gravitational force dominates the middle to coarse particulate materials free-fall trajectory thereby causing same to fall generally in the y-axis direction. Size classification of particulate materials 16 is therefore achieved and permits continuous operation, unlike screen classifiers, for example.

Advantageously, the corona-ionizing arrangement within passageway 33 is capable of effectively classifying particulate materials 16 into two narrower-sized fractions 31, 32 with a single pass. Fractions 31, 32 are either fine to middle size particulate materials or middle to coarse size particulate materials, respectively. Based on laboratory test results, particulate materials 16 subject to the corona charging arrangement of the present invention are capable of being split into two, smaller-sized paths reasonably well with approximately an eight inch drop from reservoir 12 to passageway 33 and with approximately a twenty inch free-fall space or height 37 within passageway 33.

In passageway 33, downstream from corona ionizing source 36, adjustable splitter 50 can be rotated on a horizontal axis 53*a*, substantially parallel to length 34. The position of splitter 50 may be adjusted by moving its end towards or away from sidewalls 40, 42 by moving rod 53 along about a forty-five degree path by movement of a knob adjacently outward of one end wall 41 or 43. In an alternate embodiment, a screen 49 may be installed and connected to splitter 50 within passageway 33 to aide in the classification process. Screen 49 also can be rotated along the axis of splitter 50 and preferably extends along length 34 and short of height 37 of passageway 33. Of course, screens with varying mesh sizes may be used according to the size of particulate materials 16 to be classified and separated, and particularly to prevent oversized particulate materials from being passed to drum separator section 14.

Thus, one batch of diverse particulate materials 16 having a wide range of sizes can be effectively classified into fine to middle size fraction 31 and middle to coarse size fraction 32 by corona classifier section 13, with one pass. Advantageously, corona classifier section 13 overcomes the shortcoming of not effectively classifying a wide range of particulate materials 16 with varying sizes in a single pass and doing so continuously. The ability to classify such particulate materials 16 with varying sizes is instrumental for improving workflow and efficiency. Moreover, the shortcomings of classifying particulate materials via only a screen are overcome, i.e., eliminates cleaning and maintaining the screen as well as changing the mesh-size of the screen to accommodate particulate materials having varying sizes as well as downtime therefor.

Figure 3B:
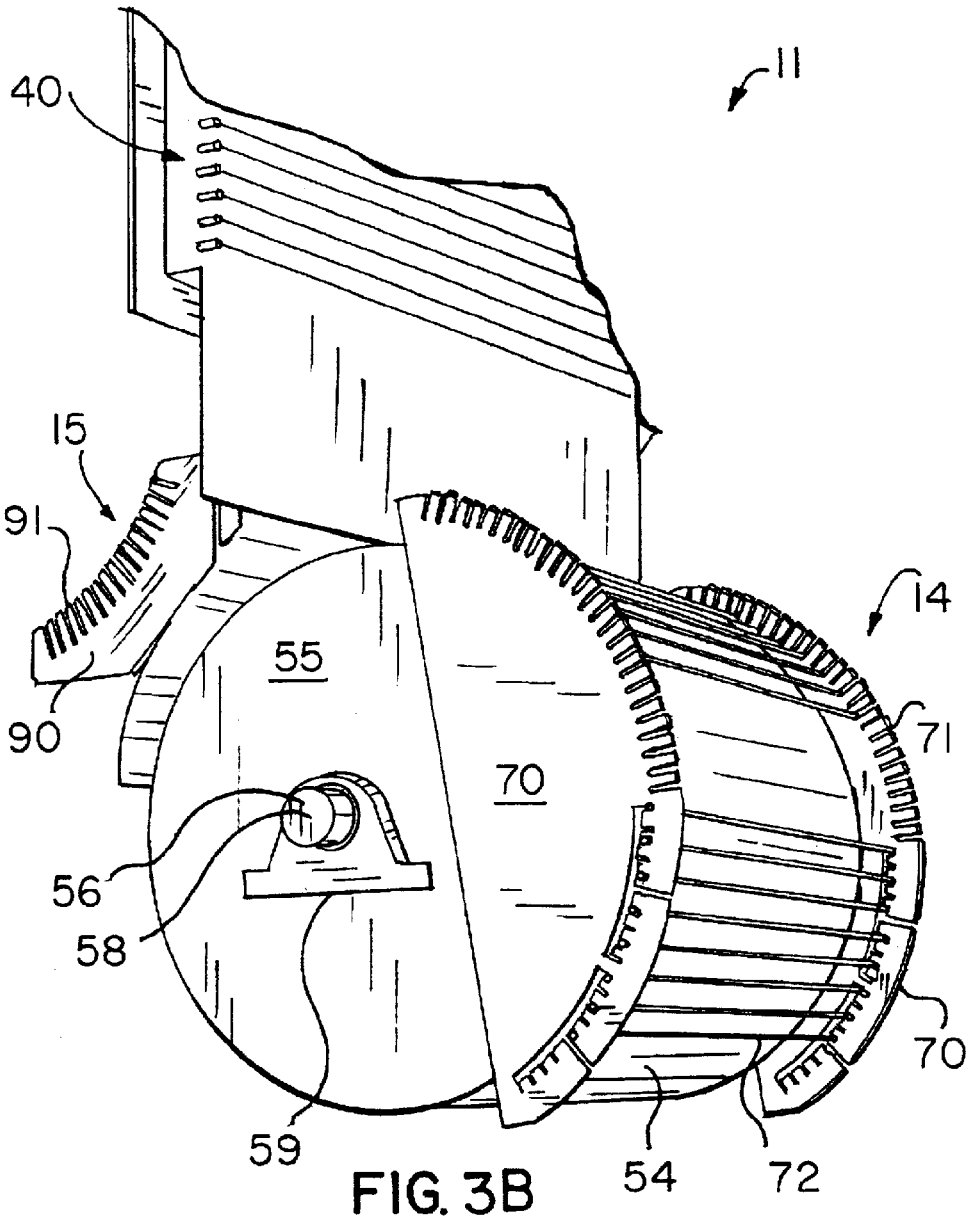
FIG. 3B is a perspective view of the high-tension electrostatic classifier and separator shown in FIG. 3A.

Now referring to FIGS. 3*a* and 3*b*, electrostatic classifier and separator 11 is depicted apart from housing 17, respectively. After particulate materials 16 have been classified by corona classification section 13 into fine to middle size fraction 31 and middle to coarse size fraction 32, such fractions may be further separated into conducting and nonconducting fractions 73–76. Fractions 31, 32 are directed toward two respective paths 51, 52 leading to first and second side-by-side separator sections, preferably drum electrode separator section 14 and plate electrode separator section 15. In alternate embodiments, other devices available in industry may be used for receiving and separating particulate materials 16 according to conductivity without deviating from the scope of the present invention with respect to the corona classification section 13.

Figure 4:
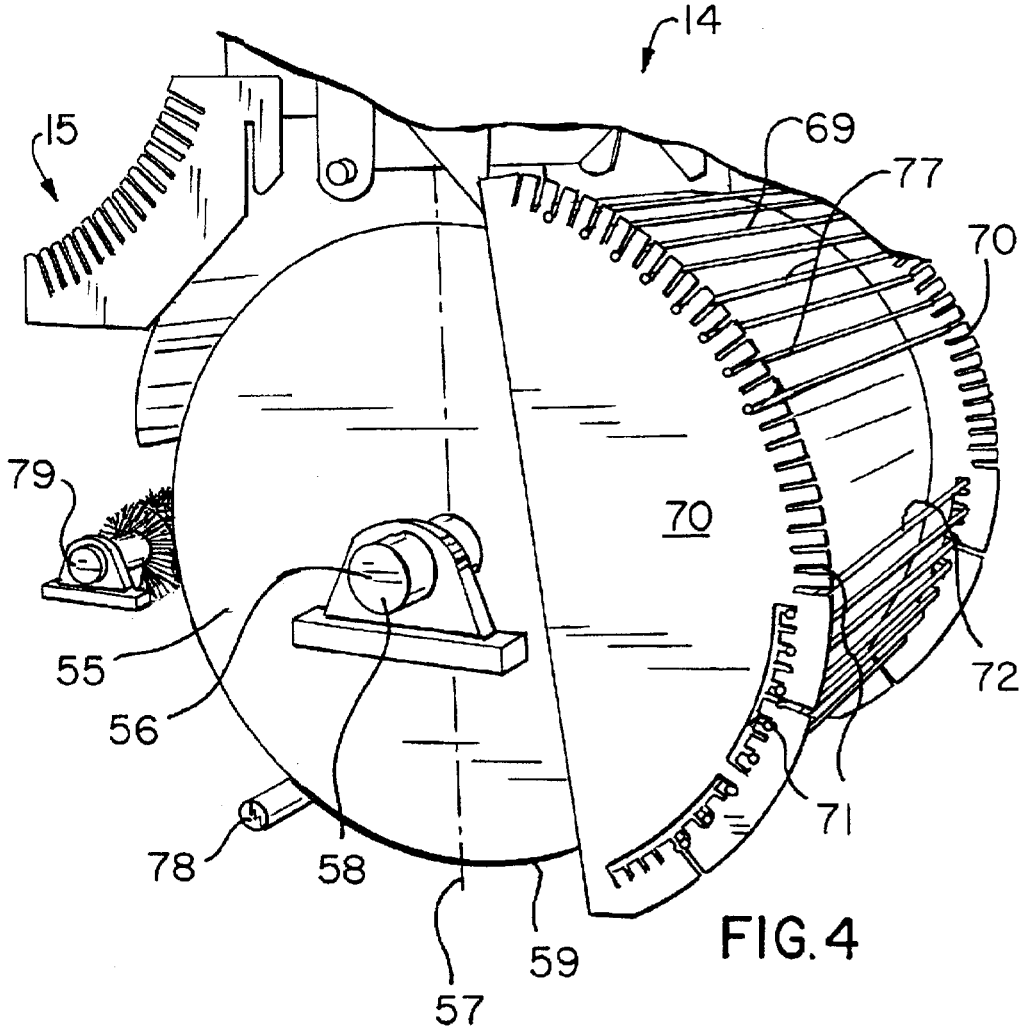
FIG. 4 is an enlarged, perspective view showing primarily the drum separator section shown in FIG. 3B.

Now referring to FIGS. 3*a*, 3*b* and 4, first path 51 directs fine to middle size fraction 31 onto outer drum surface 54 of first separator section 14. First separator section 14 has a cylindrical-shaped body 55 connected to ground and rotates about longitudinal axis 56 extending centrally of body 55. Diameter 57 of body 55 is preferably about twenty inches. Providing body 55 with such a diameter offers a higher degree of flexibility for middle size particulate materials 16 being deposited onto body 55. Of course, diameter 57 of body 55 may be adjusted, inter alia, according to the size of particulate materials 16 to be separated, as known in the art.

Conventional motors are employed to rotate body 55. Shaft 58 extends along axis 56 and is connected to and at each end of body 55. At opposing ends of body 55, shaft 58 is journaled in bearings 59 for mounting on cross member 19*a* of housing 17. Shaft 58 may be one element or may be a pair of stub shafts as well known in the art. Body 55 may be considered to have four equal sections defining four quadrants 63–66. The end of body 55 has a vertical axis 61 and a transversing horizontal axis 62 defining quadrants 63–66. First quadrant 63 includes the space defined by a ninety-degree clockwise rotation beginning from zero-degrees point 60. The second, third and fourth quadrants include respective spaces 64–66 defined by successive ninety-degree clockwise rotations from the ninety-degree point 67.

Corona-ionizing source 68 supplies charges to fine to middle size fraction 31 rotating on outer drum surface 54. Corona-ionizing source 68 is positioned spaced from cylindrical body 55 and in a general area within the first forty-five degrees of first quadrant 63. In particular, corona-ionizing source 68 is preferably located about thirty-degrees clockwise from zero-degrees point 60. In alternate embodiments, more than one corona-ionizing source 68 may be supplied for providing a greater charge to fraction 31. In addition, the location of corona-ionizing source 68 may be adjusted to different positions depending on the particulate material being separated within first quadrant 63.

Support frame 69 includes a pair of arcuate, stationary and conductive plates 70 facing each other and having aligned spaced slots 71 spacedly disposed about shaft 58 and body 55. Support frame 69 terminates spacedly above outer drum surface 54 of body 55. A plurality of spaced static electrodes 72 extend along the length of body 55 and are positioned between selectively opposing slots 71 of plates 70 from which they receive their charge. The plurality of static electrodes 72 are employed because the highest field intensity of a single static electrode configuration is at the centerline from the center of body 55 to the center of a static electrode. Thus, the field gradient decreases rapidly as the distance increases between fraction 31 and a single static electrode. Accordingly, for separating fine to middle size fraction 31, a multiple static electrode configuration is preferable since it provides a stronger and wider static field.

Spaced static electrodes 72 are preferably coated with polytetrafluoroethylene (not shown) for inhibiting electric shock when touched and for preventing arcing. Of course, other nonconducting polymers may be used to coat static electrodes 72 such as PFE, nylon and rubber, for example. The number of static electrodes 72 may be adjusted for providing various field intensities. The location of such static electrodes also can be adjusted for varying their respective distances from outer drum surface 54, if desired. For example, as fraction 31 rotates around body 55, the number of static electrodes 72 should be increased. As a result, a stronger field intensity is generated for preventing fine to middle size nonconducting particulate materials 74 from leaving outer drum surface 54 prematurely because a stronger repulsive force emanates from static electrodes 72. Further, fine to middle size conducting particles 73 may be effectively removed from outer drum surface 54 in a single pass. Static electrodes 72 are spaced from each other and may be in sets 77 some more widely spaced.

Fine to middle size conducting particulate materials 73 lose their charge to grounded outer drum surface 54 of body 55 and are drawn therefrom by static electrodes 72. Such particulate materials 73 are thereby removed from outer drum surface 54 by centrifugal and gravitational forces and thrown towards containers 27, as shown in FIG. 1, for collection or fall on respective conveyor belts (not shown) to be further processed.

Fine to middle size nonconducting particulate materials 74 are pinned to outer drum surface 54 and are retained thereon generally beyond static electrodes 72. Such nonconducting particulate materials 74 will be pinned to the grounded and conductive outer drum surface 54 beyond static electrodes 72. Upon rotating beyond about mid-second quadrant, nonconducting particulate materials 74 become free to assume normal trajectories away from grounded outer drum surface 54 under gravitational and centrifugal forces.

Nonconducting particulate materials 74, which do not assume normal trajectories away from grounded outer drum surface 54, are removed therefrom by other means such as alternating current (AC) wiper 78 and rotating brush 79, for example. Accordingly, such nonconducting particulate materials 74 are collected in respective nonconducting containers 27 and are guided by baffle 81 and adjustable splitter 80 from the conducting particles 73 previously separated from outer drum surface 54 by static electrodes 72.

AC wiper 78 is located generally in third quadrant 65 spaced from outer drum surface 54 and in a general area remotely spaced beyond where the fine to middle size nonconductive particulate materials 74 are thrown from the grounded outer drum surface 54. The AC wiper 78 thus removes most of nonconducting particulate materials 74 still pinned to outer drum surface 54 by emanating positive and negative charges upon such particulate materials 74 for neutralizing same. Such nonconducting particulate materials 74 are guided by positioning baffle 81 and are collected in a respective nonconducting container 27 or fall on respective conveyor belts (not shown) to be further processed or the like.

Elongated, rotatable brush 79 is located generally between the third and fourth quadrants and engages outer drum surface 54 to further eliminate very fine nonconducting particulate materials 75 still remaining on outer drum surface 54 beyond AC wiper 78. Brush 79 is biased toward drum surface 54 for providing a consistent and small resistive force against outer drum surface 54. Brush 79 is also journaled in bearings 59 for support thereof. Other conventional ways known in the art for maintaining brush 79 in continuous contact with outer drum surface 54 may be employed. Brush 79 preferably rotates in a direction opposite rotating body 55 for discharging nonconducting particulate materials 74 into receiving container 27. Of course, brush 79 may not be powered as outer drum surface 54 rubs thereagainst and some changes would be required in the baffle 81 to capture the discharge and possibly a repositioning of brush 79. In an alternate embodiment, brush 79 may include an ionizing source (not shown) for providing a charge and thereby further assists in removing particulate materials 74 from outer drum surface 54.

Figure 5:
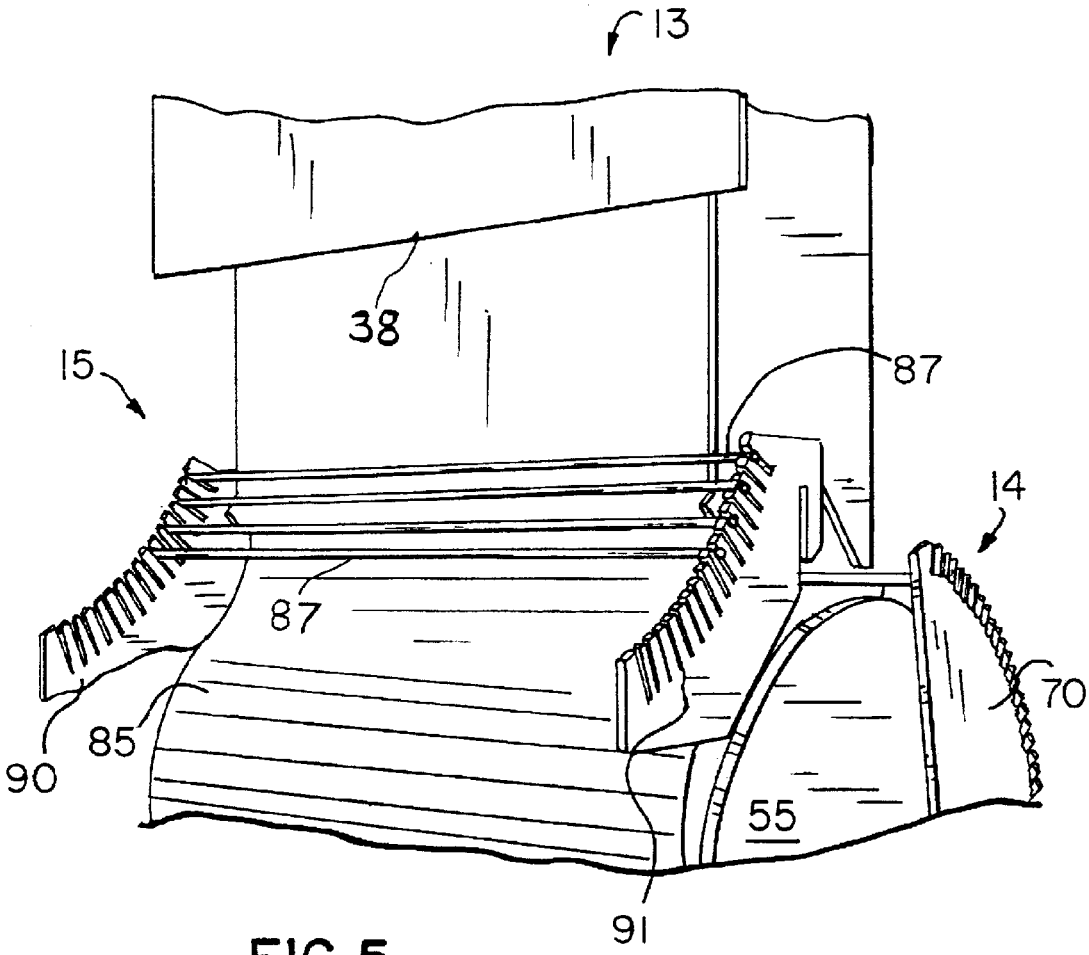
FIG. 5 is an enlarged, perspective view showing primarily the plate separator section shown in FIG. 3B.

Now referring to FIGS. 3*a* and 5, second path 52 directs middle to coarse size fraction 32 downstream from corona classifier section 13 to the second or plate electrode separator section 15. Second separator section 15 is located alongside first separator section 14 and extends in an opposite direction. Second separator section 15 has a curved, declining and electrically grounded plate 85 onto which middle to coarse size fraction 32 is introduced from passageway 33 of corona classifier section 13. Middle to coarse size fraction 32 travels on a baffled path 52 down the declining surface of grounded plate 85 due to gravity. Plate 85 of second separator section 15 is shown as curving along the general shape of body 55 of first separator section 14. Of course, the travel path of plate 85 may be altered without deviating from the scope of the present invention. The lower end of plate 85 is preferably supported by adjustable cam 86 that may be pivoted by rotating same in either direction to change the inclination thereof. Thus, the upper end of plate 85 is pivotally secured in place for allowing cam 86 to adjust the inclination of plate 85.

Middle to coarse size conductive particulate materials 76 obtain surface charges by induction when subjected to the electric field created between static electrodes 87 and grounded plate 85 whereas middle to coarse size nonconductive particulate materials 75 remain uncharged on grounded plate electrode 85. Middle to coarse size conductive particulate materials 76 are lifted off grounded plate electrode 85 due to the electrical attraction of static electrodes 87 and are thereby separated from middle to coarse size nonconductive particulate materials 75. These two separate fractions 75, 76 are directed into two separate paths by splitter 18 and are collected in two respective containers 27 (not shown) or fall on respective conveyor belts (not shown) to be further processed or the like.

Static electrodes 87 are selectively positioned and maintained in place by nonconductive arcuate end plates 90, from which the electrodes receive their charge, located on opposed sides of grounded plate 85 and define spaced slots 91. It is to be noted that the length of outer drum surface 54 along its rotative axis and the length of grounded plate electrode 85 on a line parallel to longitudinal axis 56 are generally equal so that combined separator sections 14, 15 may accommodate the full initial feed of particulate materials 16 being introduced into corona classifier section 13.

Advantageously, by directing fine to middle size fraction 31 to first roll electrode separator section 14 and middle to coarse size fraction 32 to second plate electrode separator section 15, such fractions 31, 32 may be separated into conductive and nonconductive fractions 73–76 designated by fine to middle size conductive fraction 73, fine to middle size nonconductive fraction 74, middle to coarse size nonconductive fraction 75 and middle to coarse size conductive fraction 76. Accordingly, the shortcomings of prior art that must repeat separation processes for effectively separating particulate materials 16 are substantially decreased because of the high efficiencies of the herein disclosed system and method.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A high-tension electrostatic classifier and separator for classifying and separating particulate materials based upon their size and conductivity, said separator comprising:

a corona classifier section including an elongated passageway having generally planar sidewalls defining a first end for receiving particulate materials and a second end for directing the particulate materials into two fractions according to size, and corona means located adjacent one of said sidewalls for providing ion bombardment in a horizontal direction to the particulate materials dropping down said passageway so that middle to coarse size particulate materials travel in a more generally vertical direction and fine to middle size particulate materials travel in a less generally vertical direction while passing through said passageway, a splitter located in said passageway downstream of said corona means to direct the middle to coarse size particulate materials in a first path toward said sidewall and the fine to middle size particulate materials in a second path toward another of said sidewalls;

a first separator section for receiving the fine to middle size particulate materials from said first path of said passageway and for separating same according to conductivity, said first separator section including an elongated cylindrical body having a rotative longitudinal axis and a substantially smooth outer drum surface for receiving the fine to middle size particulate materials thereon, means for rotating said body about said longitudinal axis, shaft means extending outwardly from opposite ends of said body along said longitudinal axis, a support frame disposed outwardly of said corona classifier section and said first separator section, said frame including a pair of journals to support said shaft means for supporting said corona classifier section generally above said first separator section, corona means supported by said frame located spacedly above said outer drum surface and angularly downstream from depositing the fine to middle size particulate materials on said outer drum surface, and a plurality of spaced, elongated static electrodes extending adjacent and along said outer drum surface of said body and having opposite ends supported by said frame, said plurality of static electrodes being positioned at selected locations within first and second quadrants of said cylindrical body for providing a static electric field for separating fine to middle size conductive particulate materials from said outer drum surface while fine to middle size nonconductive particulate materials remain pinned to said outer drum surface for subsequent removal as said body rotates; and a second separator section for receiving middle to coarse size particulate materials from said second path of said passageway and for separating same into conductive and nonconductive fractions, said second separator section including a curved declining grounded conductive plate, a plurality of spaced electrodes spacedly located adjacent and above said plate for producing an electric field to lift middle to coarse size conductive particulate materials from said plate while permitting middle to coarse size nonconductive particulate materials to travel by gravity on said declining plate.

2. The high-tension electrostatic classifier and separator of claim 1, further comprising a housing having a plurality of elongated and generally vertical members with respective first ends attached to corresponding corners of a base member and extending therefrom, said housing having a plurality of elongated and generally horizontal members for connecting to corresponding second ends of said plurality of generally vertical members so that said housing defines a hollow space for containing said first and second separator sections therein, said housing having means for removably securing said electrostatic separator thereto and generally within said hollow space.

3. The high-tension electrostatic classifier and separator of claim 2, wherein said housing is conductive.

4. The high-tension electrostatic classifier and separator of claim 1, further includes a screen located within said passageway and connected to said splitter for providing enhanced separation of middle to coarse size particulate materials from fine to middle size particulate materials, said screen having a mesh surface for passing fine to middle size particulate materials therethrough and for inhibiting middle to coarse size particulate materials from passing therethrough.

5. The high-tension electrostatic classifier and separator of claim 4, wherein said screen is nonconductive.

6. The high-tension electrostatic classifier and separator of claim 1, wherein said splitter includes an upper edge portion for supporting a screen extending generally between opposed said sidewalls of said passageway connected to said one sidewall, said splitter having a rotatable base generally opposite to said upper edge portion for pivoting said splitter and screen toward and away from said one sidewall.

7. The high-tension electrostatic classifier and separator of claim 1, wherein each said plurality of static electrodes is coated with a nonconductive polymer for inhibiting electric shock when touched and for preventing arcing.

8. The high-tension electrostatic classifier and separator of claim 1, wherein said first separator section further includes a rotatable brush generally midway of third and fourth quadrants for removing any remaining fine to middle size particulate materials from said outer drum surface.

9. The high-tension electrostatic classifier and separator of claim 1, further including an alternating current wiper located generally in a third quadrant for removing fine to middle size nonconductive particulate materials from said outer drum surface.

10. The high-tension electrostatic classifier and separator of claim 1, further including a plurality of containers generally below outputs from said high-tension electrostatic separator for respectively receiving the middle to coarse size conductive particulate materials and the middle to coarse size nonconductive particulate materials from said second separator section, and the fine to middle size conductive particulate materials and the fine to middle size nonconductive particulate materials from said first separator section.

11. The high-tension electrostatic classifier and separator of claim 10, wherein said plurality of containers are nonconductive.

12. The high-tension electrostatic classifier and separator of claim 11, wherein said first separator section further comprises a baffle located spacedly therefrom and generally in said third quadrant for directing fine to middle size particulate materials into a corresponding one of said plurality of containers.

13. The high-tension electrostatic classifier and separator of claim 1, wherein said splitter is adjustable on an axis extending parallel to said longitudinal axis of said body.

14. The high-tension electrostatic classifier and separator of claim 1, wherein said first separator section further includes a splitter located spacedly therefrom and generally in said second quadrant for separating fine to middle size conductive particulate materials from fine to middle size nonconductive particulate materials, said splitter being adjustable on an axis extending parallel to said longitudinal axis of said body.

15. The high-tension electrostatic classifier and separator of claim 1, wherein said second separator section further includes a splitter located spacedly between said plate and said electrodes for separating middle to coarse size conductive particulate materials from middle to coarse size nonconductive particulate materials, said splitter being adjustable on an axis extending parallel to said longitudinal axis of said body.

16. The high-tension electrostatic classifier and separator of claim 1, further including a reservoir above said passageway for feeding said particulate materials therein by gravity into a thin stream generally equal along and spaced from said one sidewall of said passageway.

17. The high-tension electrostatic classifier and separator of claim 1, wherein said corona classifier section further comprises a plurality of baffles extending along said length of said passageway and spaced from each other in the general path of said middle to coarse size particulate materials, said plurality of baffles for retarding the fall of said middle to coarse size particulate materials.

18. In a high-tension electrostatic classifier and separator for classifying and separating particulate materials based upon size and conductivity comprising:

a corona classifier including an elongated passageway having generally planar sidewalls defining a first end for receiving particulate materials and a second end for directing the particulate materials into two fractions according to size, and corona means located adjacent one of said sidewalls for providing ion bombardment in a horizontal direction to the particulate materials dropping down said passageway so that middle to coarse size particulate materials travel in a more generally vertical direction and fine to middle size particulate materials travel in a less generally vertical direction while passing through said passageway, a splitter located in said passageway downstream of said corona means to direct the middle to coarse size particulate materials in a first path toward said sidewall and the fine to middle size particulate materials in a second path toward another of said sidewalls.

19. In the high-tension electrostatic classifier and separator of claim 18, wherein the corona classifier further includes means for receiving the fine to middle size particulate materials and the middle to coarse size particulate materials from said corona classifier section and for separating the particulate materials into a plurality of distinct fractions.

20. In the high-tension electrostatic classifier and separator of claim 18, wherein said corona means includes a plurality of spacers extending from said one sidewall in a generally horizontal direction and between opposed said sidewalls of said passageway; and a plurality of spaced corona electrodes extending adjacent and along said one sidewall and having opposite ends connected to said plurality of spacers so that said plurality of static electrodes are spaced from said one sidewall.

21. In the high-tension electrostatic classifier and separator of claim 20, wherein said plurality of spacers is conductive for providing corona charge to said plurality of corona electrodes.

22. In the high-tension electrostatic classifier and separator of claim 18, wherein said splitter is adjustable on an axis extending generally parallel to a length of said passageway.

23. In the high-tension electrostatic classifier and separator of claim 18, further including a reservoir above said passageway for feeding said particulate materials therein by gravity into a thin stream generally equal along and spaced from said one sidewall of said passageway.

24. In the high-tension electrostatic classifier and separator of claim 18, wherein said sidewalls are conductive.

25. In the high-tension electrostatic classifier and separator of claim 18, further including a screen located within said passageway and connected to said splitter for providing enhanced separation of middle to coarse size particulate materials from fine to middle size particulate materials, said screen having a mesh surface for passing fine to middle size particulate materials therethrough and for inhibiting middle to coarse size particulate materials from passing therethrough.

26. In the high-tension electrostatic classifier and separator of claim 25, wherein said screen is nonconductive.

27. In the high-tension electrostatic classifier and separator of claim 26, wherein said splitter includes an upper edge portion for supporting said screen extending generally between opposed said sidewalls of said passageway connected to said one sidewall, said splitter having a rotatable base generally opposite to said upper edge portion for pivoting said splitter and screen toward and away from said one sidewall.

28. In the high-tension electrostatic classifier and separator of claim 18, wherein the corona classifier further comprises a housing having a plurality of elongated and generally vertical members with respective first ends attached to corresponding corners of a base member and extending therefrom, said housing having a plurality of elongated and generally horizontal members for connecting to corresponding second ends of said plurality of generally vertical members so that said housing defines a hollow space for supporting said corona classifier.

29. In the high-tension electrostatic classifier and separator of claim 28, wherein said housing is conductive.

30. A method for classifying and separating particulate conductive and nonconductive materials, the method including:

(a) passing the particulate materials through a passageway in close proximity to a corona source for charging thereof;

(b) classifying the particulate materials traveling through the passageway according to size so that the particulate materials are directed into diverging paths with a first path being for fine to middle size particulate materials, and a second path being for middle to coarse size particulate materials;

(c) separating the fine to middle size particulate materials into conductive and nonconductive fractions with a rotating cylindrical grounded outer drum surface for carrying the fine to middle size particulate materials past a corona charging location so that conductors of the fine to middle size particulate materials are removed from the outer drum surface by a plurality of spaced static electrodes, the nonconductors of the fine to middle size particulate materials remain on the rotating outer drum surface until they drop off or are removed from the outer drum surface prior to a full rotation of the outer drum surface;

(d) separating the middle to coarse size particulate materials into conductors and nonconductive fractions with a curved declining grounded plate so that conductive middle to coarse size particulate materials passing on the plate are lifted off therefrom due to an electrical field of another plurality of spaced static electrodes spaced above and along the plate and are separated from nonconductive middle to coarse size particulate materials remaining on the plate and falling therefrom; and (e) collecting the separated conductive fine to middle size fraction from the nonconductive fine to middle size fraction, and the separated conductive middle to coarse size fraction from the nonconductive middle to coarse size fraction.

31. The method of claim 30, wherein step (b) includes:

installing an adjustable splitter and a screen attached thereto in the passageway for providing enhanced classification of fine to middle size particulate materials from middle to coarse size particulate materials.

32. The method of claim 30, wherein step (c) includes:

installing an adjustable splitter for directing the fine to middle size particulate materials into a conductive fraction and a nonconductive fraction.

33. The method of claim 30 wherein step (d) includes:

installing an adjustable splitter for directing middle to coarse size particulate materials into a conductive fraction and a nonconductive fraction.

34. The method of claim 30, wherein step (e) includes:

placing a plurality of spaced containers adjacent to a respective path of middle to coarse size conductive particulate materials and middle to coarse size nonconductive particulate materials, and fine to middle size conductive particulate materials and fine to middle size nonconductive particulate materials and for collecting thereof.

35. The method of claim 30, further including:

(f) installing an alternating current wiper generally in the third quadrant and spacedly adjacent the outer drum surface for removing fine to middle size conductive particulate materials therefrom.

36. The method of claim 30, further including:

(g) installing a rotatable mechanical brush generally between third and fourth quadrants and spacedly adjacent the outer drum surface for removing fine to middle size nonconductive particulate materials therefrom.

37. The method of claim 30, further including:

(h) coating the plurality and the another plurality of spaced static electrodes with a nonconducting polymer for inhibiting electric shock when touched and for preventing arcing.

38. A method for classifying and collecting particulate materials according to size, said method including:

(a) passing the particulate materials through a passageway in close proximity to a corona source for charging thereof;

(b) classifying the particulate materials traveling through said passageway according to size so that the particulate materials are directed into diverging paths with a first path being for fine to middle size particulate materials and a second path being for middle to coarse size particulate materials; and (c) collecting the separated fine to middle size fraction and the separated middle to coarse size fraction.

39. The method of claim 38, wherein step (b) includes:

installing an adjustable splitter and a screen attached thereto in the passageway for providing enhanced classification of fine to middle size particulate materials from middle to coarse size particulate materials.

40. The method of claim 38, wherein step (c) includes:

placing a plurality of spaced containers adjacent to a respective path of middle to coarse size conductive particulate materials and middle to coarse size nonconductive particulate materials, and fine to middle size conductive particulate materials and fine to middle size nonconductive particulate materials and for collecting thereof.

41. The method of claim 38 further comprising:

(d) separating each of the particulate materials in the first and second paths into conductive and nonconductive particulate materials.

* * * * *